United States Patent [19]

Kuriyama

[11] Patent Number: 5,004,038

[45] Date of Patent: Apr. 2, 1991

[54] DEGASSING APPARATUS FOR MOLD

[75] Inventor: Minoru Kuriyama, Yamaguchi, Japan

[73] Assignee: UBE Industries, Ltd., Ube, Japan

[21] Appl. No.: 442,213

[22] Filed: Nov. 28, 1989

[30] Foreign Application Priority Data

Nov. 29, 1988 [JP] Japan ..... 63-299447
Dec. 6, 1988 [JP] Japan ..... 63-306885

[51] Int. Cl.[5] ..... B22D 17/14
[52] U.S. Cl. ..... 164/305; 164/410
[58] Field of Search ..... 164/305, 410; 425/420, 425/812

[56] References Cited

U.S. PATENT DOCUMENTS 4,431,047 2/1984 Takeshima et al. .
4,489,771 12/1984 Takeshima et al. .
4,538,666 9/1985 Takeshima et al. .
4,691,755 9/1987 Kuriyama et al. .
4,779,667 10/1988 Fujino et al. .
4,782,886 11/1988 Uchida et al. .

FOREIGN PATENT DOCUMENTS 60-37258 2/1985 Japan .
63-60059 3/1988 Japan .
63-115663 5/1988 Japan .

*Primary Examiner*—Kuang Y. Lin
*Attorney, Agent, or Firm*—Blakely, Sokoloff, Taylor & Zafman

[57] ABSTRACT

A degassing apparatus for a mold includes a degassing valve, an acoustic wave detecting unit, and a valve closing unit. The degassing valve is located at an end portion of a degassing passage extending from a mold cavity. The acoustic wave detecting unit is arranged midway along the degassing passage and detects an acoustic wave generated when a molten metal collides against a wall surface of the passage, and thereby detecting passing of the molten metal. The valve closing unit closes the valve when a detection signal level is higher than a reference signal level.

5 Claims, 12 Drawing Sheets

DEGASSING APPARATUS FOR MOLD

BACKGROUND OF THE INVENTION

The present invention relates to a degassing apparatus for a mold for breathing a mold cavity upon injection molding performed by an injection molding apparatus such as a die-casting machine or an injection molding press.

A conventional relevant technique similar to the present invention is described in Japanese Patent Laid-Open No. 63-60059. In this technique, a molten metal sensor constituted by two electrodes insulated from each other is short-circuited when a molten metal from a cavity reaches the sensor, and a switching circuit is immediately activated accordingly to energize an air solenoid valve or an electromagnetic coil, thereby closing a degassing valve.

In the above conventional technique, when a molten metal moves in the form of a mass from the cavity through a degassing passage, this molten metal can be easily detected. Therefore, since the degassing valve is closed, the molten metal is prevented from entering into the degassing valve. In actual casting, however, a molten metal from the cavity rarely moves in the form of a mass from the cavity through the degassing passage. Generally, the molten metal is often flaky or granular. Since the molten metal sensor is constituted by the two insulated electrodes, it cannot detect these flakes or grains. Therefore, the degassing valve is not closed, and the molten metal flakes or grains enter into the degassing valve and cut into the sheet surface of the valve. As a result, a large amount of the molten metal sometimes enters into the degassing valve.

SUMMARY OF THE INVENTION

It is an object of the present invention to provide a degassing apparatus for a mold capable of reliably detecting a molten metal moving from a cavity through a degassing passage.

According to the present invention, there is provided a degassing apparatus for a mold comprising a degassing valve located at an end portion of a degassing passage extending from a mold cavity, an acoustic wave detecting unit, arranged midway along the degassing passage, for detecting an acoustic wave generated when a molten metal collides against a wall surface of the passage, and thereby detecting passing of the molten metal, and a valve closing unit for closing the valve when a detection signal level is higher than a reference signal level.

According to the degassing apparatus for a mold having the above arrangement of the present invention, an acoustic wave generated when a molten metal moving toward the degassing valve through the degassing passage collides against a mold wall is detected by the detector. When the detection signal level is higher than the reference level, an electrical signal indicating that the molten metal reaches the acoustic detector is generated, and the degassing valve is closed by this electrical signal.

BRIEF DESCRIPTION OF THE DRAWINGS

FIGS. 1 and 2 shows the first embodiment of a degassing apparatus for a mold according to the present invention, in which FIG. 1 is a sectional view showing a degassing apparatus and a part of a mold comprising the degassing apparatus and taken along the line I—I in FIG. 2, and FIG. 2 is a sectional view taken along the line II—II;

DETAILED DESCRIPTION OF THE PREFERRED EMBODIMENTS

Preferred embodiments of the present invention will be described below with reference to the accompanying drawings.

Figure 1:
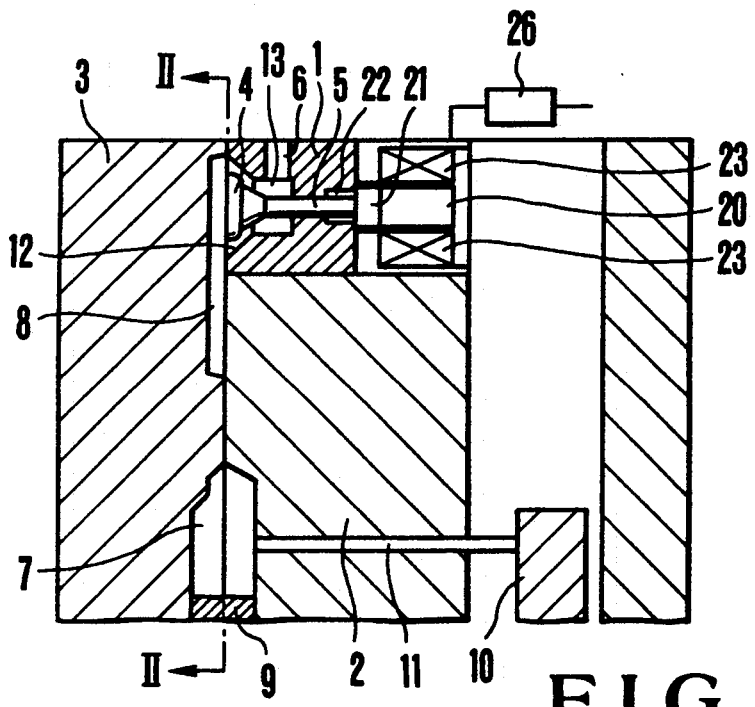
Figure 2:
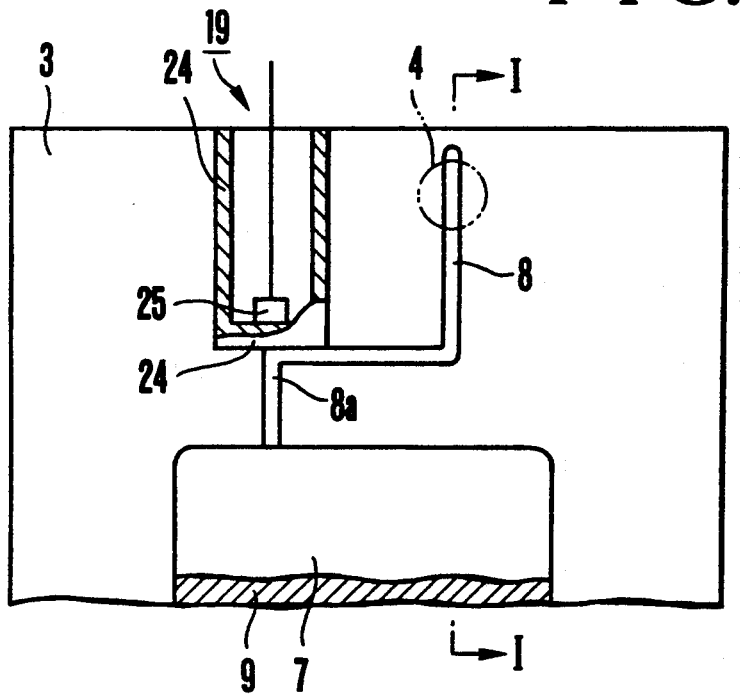
Figure 3:
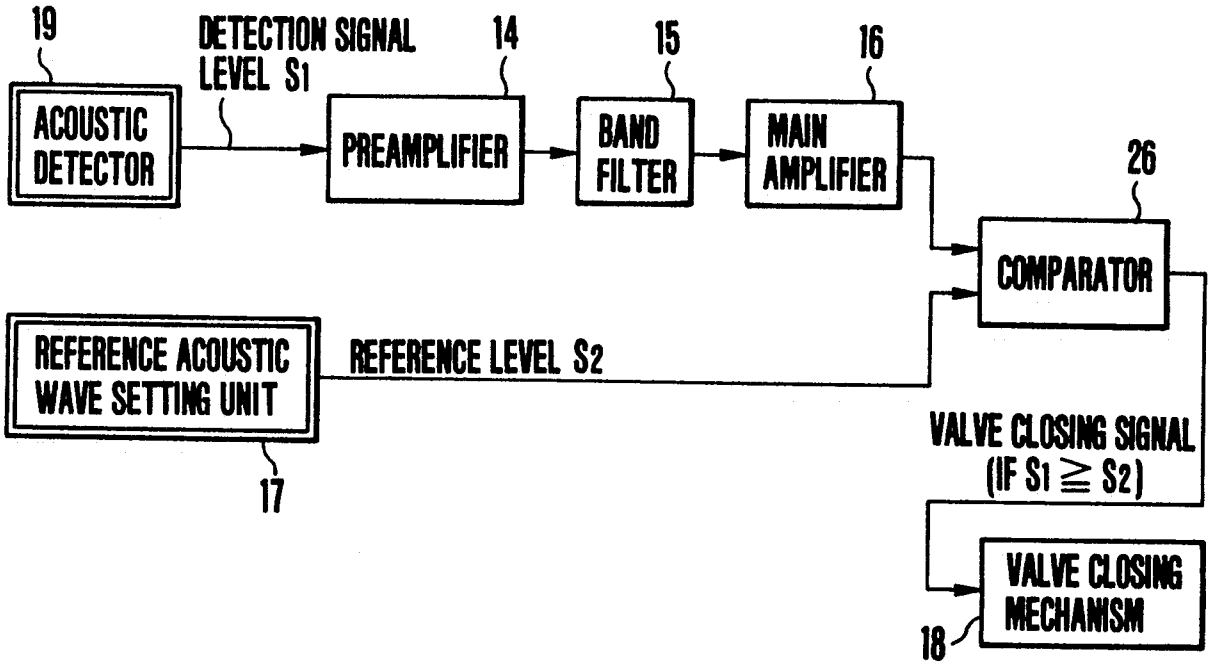
FIG. 3 is a block diagram showing a valve closing command system based on acoustic wave detection.

FIG. 1 shows a degassing apparatus and a mold comprising the degassing apparatus and taken along the line I—I in FIG. 2, FIG. 2 shows the structure of FIG. 1 along the line II—II thereof and FIG. 3 shows a valve closing command system based on acoustic wave detection.

Referring to FIGS. 1 and 2, reference numeral 2 denotes a movable mold; 3, a stationary mold; 7, a product cavity; 9, a molten metal; 10, an extrusion plate; and 11, an extrusion pin. A degassing valve 1 is fitted in a recess formed in an upper portion of the movable mold 2 and is slidable forward and backward together with the movable mold 2. The degassing valve 1 is mounted on an upper portion of the product cavity 7 via a degassing groove 8. As shown in FIG. 2, the degassing groove 8 is bent, and a detector 19 for detecting the magnitude of an amplitude of an acoustic wave generated upon collision of the molten metal 9 and thereby detecting reaching of the molten metal 9 is disposed at a bent portion 8*a* in the middle of the degassing groove 8. The degassing valve 1 is constituted by a valve disc 4, a valve stem 5, a gas exhaust hole 6, a valve seat 12, a gas exhaust chamber 13, a core 20, a joint 21, a compression coil spring 22, and a solenoid 23. The core 20 is coupled to the rear portion of the valve stem 5 via the joint 21, and the valve disc 4 is coupled to the front portion of the valve stem 5. A solenoid 23 is arranged along the circumference of the core 20. When the solenoid 23 is energized, the core 20 is moved to the left in FIG. 1, and the valve disc 4 is separated from the valve seat 12 to open the degassing valve 1 as shown in FIG. 1. When energization of the solenoid 23 is stopped, i.e., when the electric circuit is deenergized, the valve disc 4 is brought into contact with the valve seat 12 by extension of the compression coil spring 22, and the degassing valve 1 is closed. The detector 19 for detecting reaching of the molten metal 9 is constituted by a sensor block 24 and an acoustic sensor 25. Data detected by the detector 19, i.e., an amplitude of an acoustic wave generated upon collision of the molten metal 9 is compared by a comparator 26 with a reference value set by a reference acoustic wave setting unit 17, i.e., the minimum amplitude of an acoustic wave which is obtained by experiments or tests and enables detection of reaching of the molten metal 9. When the data exceeds the reference value, reaching of the molten metal 9 is determined, and a valve closing command signal is output to the solenoid 23.

An operation of the degassing apparatus for a mold having the above arrangement will be described below.

The solenoid 23 is energized by the comparator 26 before the molten metal 9 is injected into the product cavity 7. Since the action of the solenoid 23 is larger than that of the compression coil spring 22, the degassing valve 1 is open. In this state, the molten metal 9 is injected into the product cavity 7. After the molten metal 9 almost fills the product cavity 7, it reaches the degassing groove 8. The molten metal 9 moving straight through the degassing groove 8 collides against the sensor block 24 provided at the bent portion 8*a* of the groove. The acoustic sensor 25 detects this collision sound and sends a signal to the comparator 26. The comparator 26 compares a detection signal level $S_1$ from the acoustic sensor 25 with a predetermined reference level $S_2$. If the detection signal level $S_1$ is higher than the reference level $S_2$, the comparator 26 interrupts a current supplied to the solenoid 23. As a result, the degassing valve 1 is closed by the action of the compression coil spring 22. In this case, the length of the degassing groove 8 from the bent portion 8*a* to the degassing valve 1 portion is set so that the molten metal 9 reaches the degassing valve 1 portion after the degassing valve 1 is closed. Therefore, the molten metal 9 is prevented from entering into the degassing valve 1.

In addition, if the reference level is set at a maximum detection signal level obtained when flakes or grains of the molten metal 9 which can be allowed to enter into the degassing valve 1 collide against the sensor block 24, breathing can be performed such that a gas amount remaining in the product cavity 7 is always stably reduced without permitting the molten metal 9 to enter into the degassing valve 1.

As shown in FIG. 3, an acoustic wave of a collision sound generated when the molten metal 9 moving straight through the degassing groove 8 collides against the sensor block 24 is received by the acoustic sensor 25, and an output (detection signal level $S_1$) from the sensor is amplified by a preamplifier 14. The amplified output is filtered by a band filter 15, amplified again by a main amplifier 16, and then compared with the reference signal level ($S_2$) set by the reference acoustic wave setting unit 17 and input to the comparator 26. If $S_1 \geqq S_2$, the comparator 26 determines that the molten metal 9 collides against the sensor block 24 disposed midway along the degassing groove 8, and generates a valve closing command. As a result, the electric circuit of the solenoid 23 forming a part of a valve closing mechanism 18 is deenergized, and the valve disc 4 coupled to the valve stem 5 is brought into contact with the valve seat 12 by the returning force of the compression spring 22, thereby stopping exhaustion of a gas from the gas exhaust hole 6 via the degassing groove 8 and the gas exhaust chamber 13.

In this embodiment, the present invention adopts the degassing valve 1 operated by the solenoid 23. The present invention, however, may adopt a degassing valve operated by a fluid pressure. In addition, the present invention may be incorporated in a valve which can be closed even by a collision force of the molten metal 9 as disclosed in Japanese Patent Application No. 62-288515 according to the invention of the present inventor.

Furthermore, the degassing valve 1 can be mounted on the stationary mold 3.

Moreover, in the above embodiment, the structure in which the gas exhaust hole 6 is open to the air is illustrated and explained. The gas exhaust hole 6, however, may be coupled to a vacuum suction unit so that the molten metal 9 is injected while a pressure in the product cavity 7 is reduced.

As is apparent from the above description, according to this embodiment, the detector, arranged midway along the molten metal passage, for detecting an acoustic wave generated when a molten metal collides against a mold wall surface and thereby detecting reaching of the molten metal is connected to the valve closing mechanism for comparing the detection signal level with the reference level and closing the degassing valve by the electrical signal when the detection signal level is higher than the reference level. Therefore, the product cavity can always be stably breathed without permitting a large amount of the molten metal to enter into the degassing valve.

Figure 4:
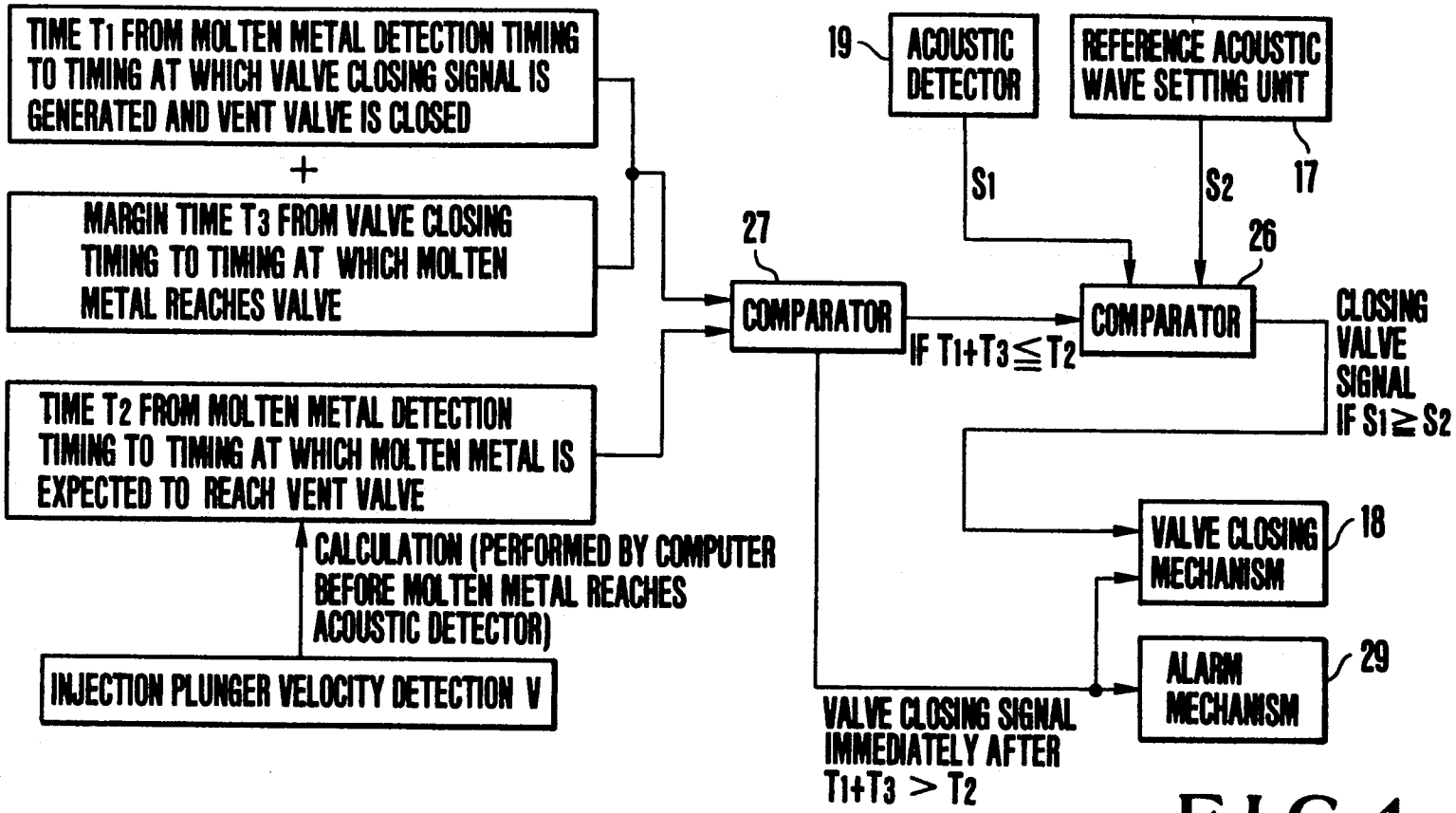
FIG. 4 is a block diagram showing a valve closing command system based on injection plunger moving velocity detection.

In the above embodiment, the detector 19 is utilized to close the degassing valve 1 before the molten metal 9 reaches the degassing valve 1. That is, as shown in FIG. 4, in order to detect the moving velocity of an injection plunger 4, a striker is provided to an injection plunger of an injection cylinder or a rod formed integrally with the injection plunger. As the injection plunger moves forward, a magnetic scale unit, arranged on the striker, for detecting a movement position is used to detect an injection plunger velocity V upon high-speed injection by using a timer. Immediately after this detection, a time $T_2$ from a molten metal detection timing to an expected timing at which the molten metal 9 reaches the degassing valve 1 is calculated by a computer. A time $T_1$ from the molten metal detection timing to a timing at which a valve closing signal is generated to close the degassing valve 1, and a margin time $T_3$ from the closing timing of the degassing valve 1 to a timing at which the molten metal reaches the valve are predetermined. A comparator 27 different from the comparator 26 compares $T_1+T_3$ with $T_2$. If $T_1+T_3 \leqq T_2$, the valve closing signal is generated after a collision sound of the molten metal 9 is detected by the acoustic detector 19 and before the molten metal 9 reaches the degassing valve 1. If $T_1+T_3>T_2$, the valve closing signal is supplied to the valve closing mechanism 18 and an alarming mechanism is driven to generate an alarm immediately after $T_1+T_3>T_2$ is confirmed. Therefore, the valve closing signal is output to the solenoid 23 electrically connected to the comparator 27 before the molten metal 9 reaches the degassing valve 1. Note that $T_1$ is a value which can be obtained by actually operating the apparatus. In addition, $T_3$ is a value about 1 to several msec which can be arbitrarily predetermined.

The valve closing command shown in FIG. 4 will be quantitatively explained with reference to FIGS. 5 and 6.

Figure 5:
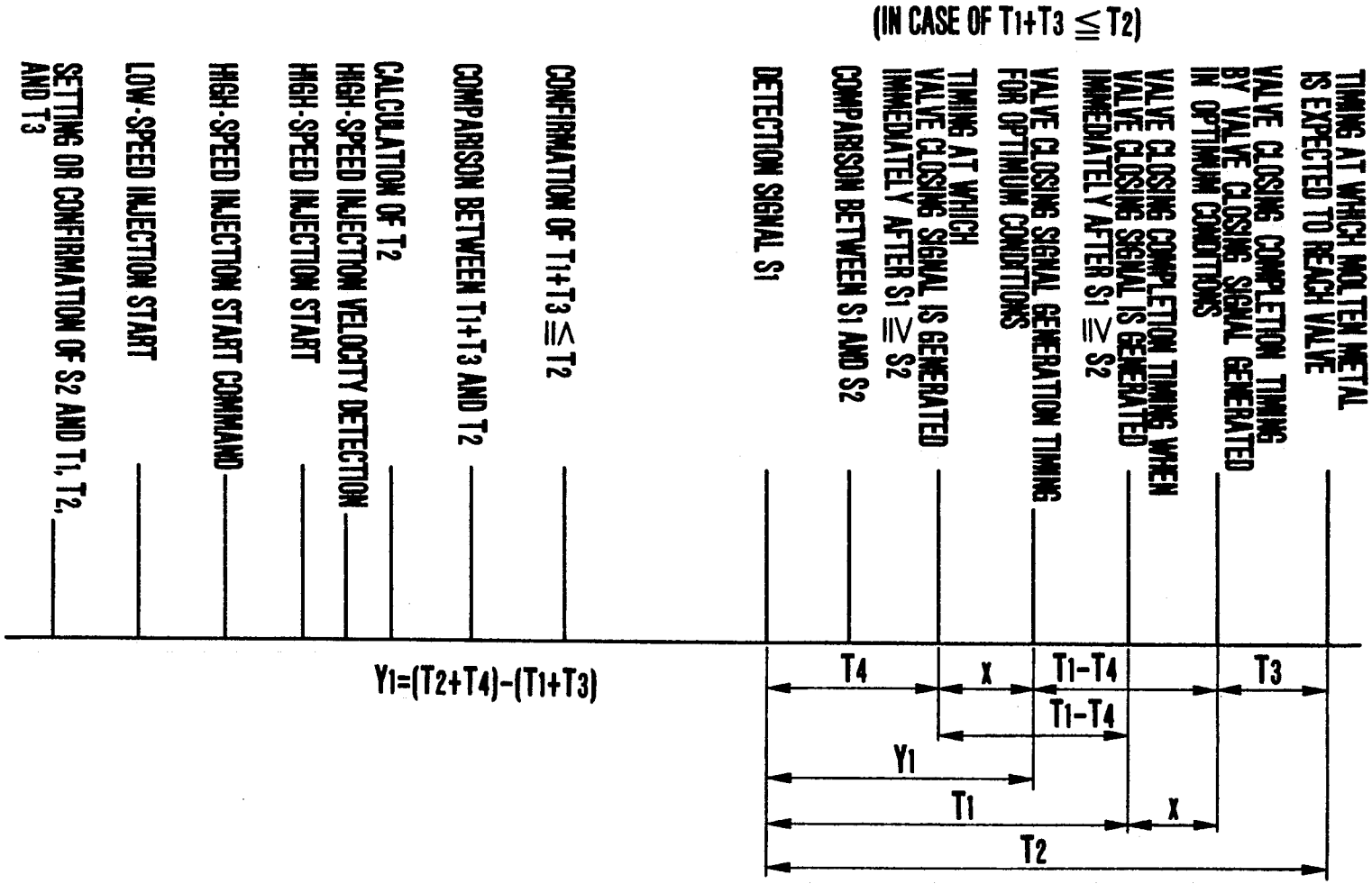
FIG. 5 is a view showing an operation sequence performed when $T_1+T_3 \leqq T_2$.

As shown in FIG. 5, after the injection plunger velocity V described above is detected, $T_2$ is calculated by the computer and compared with $T_1+T_3$ by the comparator 27. If $T_1+T_3 \leqq T_2$, i.e., if the time $T_2$ from the timing at which the molten metal 9 is detected by the acoustic detector 19 to the timing at which the molten metal is expected to reach the degassing valve 1 is longer than the sum of the time $T_1$ from molten metal detection timing to the degassing valve 1 closing timing and the margin time $T_3$, the valve closing signal for closing the degassing valve 1 is generated immediately before the molten metal 9 reaches the degassing valve 1. Before a valve closing operation is actually started, however, another condition must be satisfied. That is, the detection signal level $S_1$ generated when the molten metal 9 collides against the acoustic detector 19 is compared with the reference level $S_2$. If $S_1 \geqq S_2$, the valve closing signal is generated, so that the molten metal 9 is caused to reach the degassing valve 1 after valve closing is actually completed. As shown in FIG. 5, in order to minimize a gas amount remaining in the mold cavity 7, the collision sound $S_1$ of the molten metal 9 is detected by the acoustic detector 19, and $S_1$ and $S_2$ are compared. Assuming that a time required to generate the valve closing signal for the degassing valve 1 in the case of $S_1 \geqq S_2$ is $T_4$, the valve closing signal is preferably generated at a timing offset from $T_4$ by a microtime x. That is, a theoretical time $Y_1$ from the timing at which the collision sound of the molten metal 9 is detected by the acoustic detector 19 to the timing at which the valve closing signal is generated so that the gas amount remaining in the mold cavity 7 and the degassing groove 8 is minimized while the molten metal is prevented from entering into the degassing valve is given as $Y_1=(T_4+T_2)-(T_1+T_3)$. In this case, $x=T_2-(T_1+T_3)$. When x is infinitely reduced, $T_1+T_3=T_2$ is finally obtained, thereby minimizing the gas amount remaining in the mold cavity 7. Note that $S_2$, $T_1$, $T_3$, and $T_4$ can be set or calculated beforehand by experiments and tests and therefore can be input to the comparators 26 and 27 beforehand.

Figure 6:
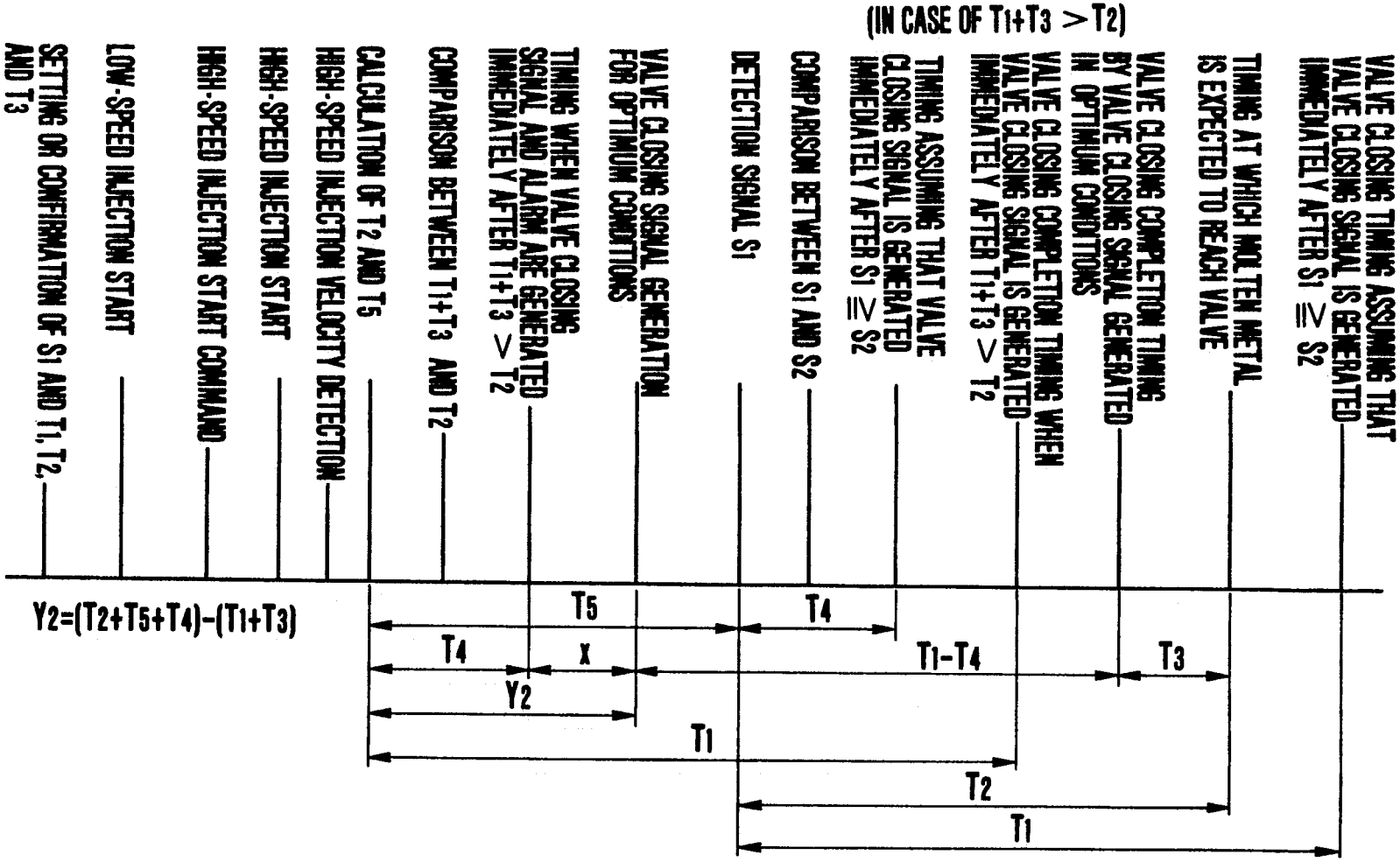
FIG. 6 is a view showing an operation sequence performed when $T_1+T_3 > T_2$.

Referring to FIG. 6, as in FIG. 5, after the injection plunger velocity V is detected, $T_2$ is calculated by a computer, and $T_1+T_3$ is compared with $T_2$ by the comparator 27. If $T_1+T_3>T_2$, i.e., at a certain injection plunger velocity, if a time $T_2$ from the detection timing of the molten metal 9 to the timing at which the molten metal 9 is expected to reach the degassing valve 1 is shorter than a time $T_1$ from the molten metal detection timing to the timing at which the degassing valve 1 is closed by an electrical signal, the comparator 26 interrupts the current from the solenoid 23 before the molten metal during injection reaches the detector 19 constituted by the sensor block 24 and the acoustic sensor 25, closes the degassing valve 1, and generates an alarm immediately before the molten metal 9 reaches the degassing valve 1. In this case, the time required for the molten metal 9 to reach the degassing valve 1 after it reaches the detector 19 at a certain injection plunger velocity during injection is calculated by the moving velocity of the injection plunger supplied to the comparator 26.

Referring to FIG. 6, as in FIG. 5, in order to minimize the gas amount remaining in the mold cavity 7, after the injection plunger velocity is detected and $T_2$ is calculated, $T_1+T_3$ is compared with $T_2$ by the comparator 27. Assuming that a time from detection of the injection plunger velocity to the timing at which the valve closing signal is generated immediately after $T_1+T_3>T_2$ is determined is $T_4$, the valve closing signal is generated at a timing offset from $T_4$ by a microtime x. In this manner, a theoretical minimum gas amount remaining in the cavity 7 and the degassing groove 8 is obtained, and a theoretical time $Y_2$ for preventing the molten metal from entering into the degassing valve is given as $Y_2=(T_2+T_5+T_4)-(T_1+T_3)$.

In the above equation, $T_5$ is a time from the timing at which $T_2$ is calculated to the timing at which the collision sound $S_1$ of the molten metal is detected. $T_5$ is immediately calculated upon detection of the injection plunger velocity.

As is apparent from the above description, in the degassing apparatus for a mold according to the above embodiment, even if the injection plunger velocity is higher than that obtained when the length of the degassing groove is set, the degassing valve does not clog with the molten metal. In addition, even if the injection plunger velocity is lower than that obtained when the length of the degassing groove is set, a gas amount remaining in the mold cavity can be reduced.

Figure 7:
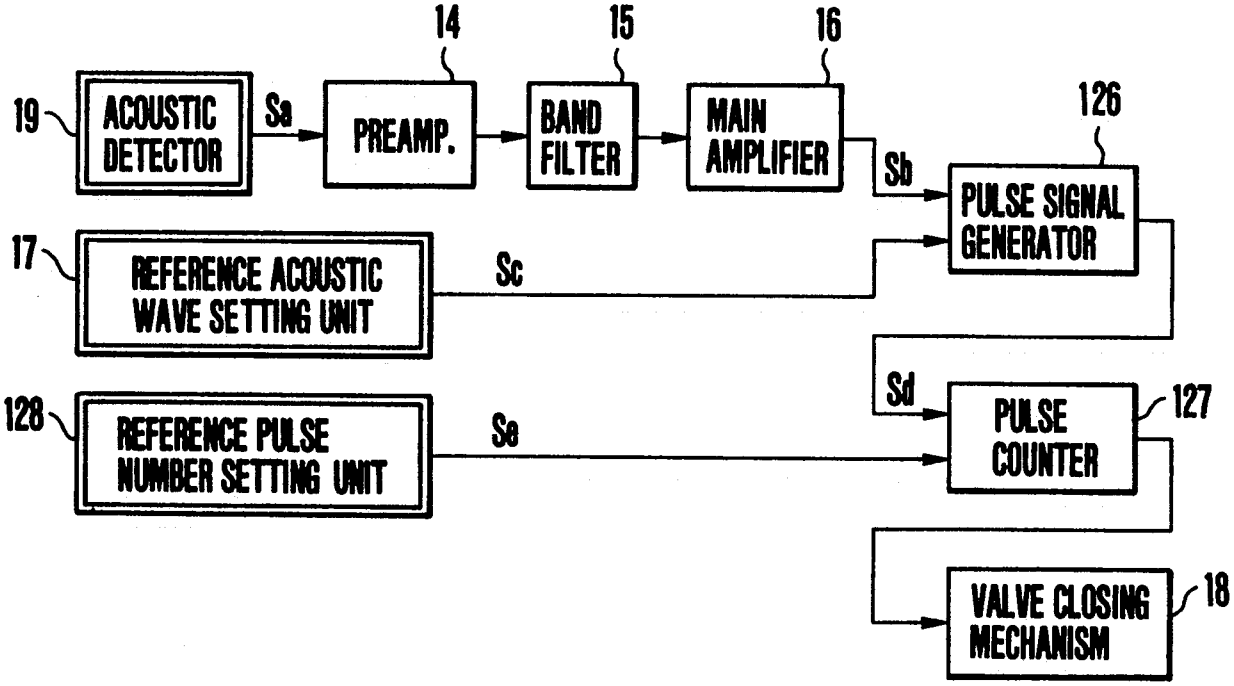
FIG. 7 is a block diagram showing another embodiment of a degassing apparatus for a mold according to the present invention.

FIG. 7 shows another embodiment of the present invention. In this embodiment, an acoustic wave generated when a molten metal passing through a mold cavity and moving toward a degassing valve through a degassing passage collides against a mold wall is detected by a detecting means. If a detection signal level from this detecting means is higher than a reference level, an electrical signal pulse is generated. When the count of a pulse counter reaches a predetermined value, an electrical signal is generated to close the valve.

Referring to FIG. 7, an acoustic wave of a collision sound generated when a molten metal 9 moving straight through a degassing groove 8 collides against a sensor block 24 is received by an acoustic sensor 25 of an acoustic detector 19, and an output signal (a signal of level Sa) from the sensor 19 is amplified by a preamplifier 14. The amplified signal is passed through a band filter 15, and amplified again by a main amplifier 16 to obtain a signal of level Sb The signal of level Sb is compared with a reference signal of level Sc predetermined by a reference acoustic wave setting unit 17 and input to a pulse signal generator 126. If $Sb \geqq Sc$, the pulse signal generator 126 generates a pulse signal. The pulse signal is counted by a pulse counter 127. If a counted pulse number Sd is larger than a set pulse number Se from reference pulse number setting unit 128, a valve closing signal is output to a valve closing mechanism 18. In response to the valve closing signal, an electric circuit of a solenoid 1 shown in FIG. 1 is deenergized, and a valve disc 4 coupled to a valve stem 5 is brought into contact with a valve seat 12 by the returning force of a compression coil spring 22, thereby stopping exhaustion of a gas from a gas exhaust hole 6 via the degassing groove 8 and a gas exhaust chamber 13.

Figure 11:
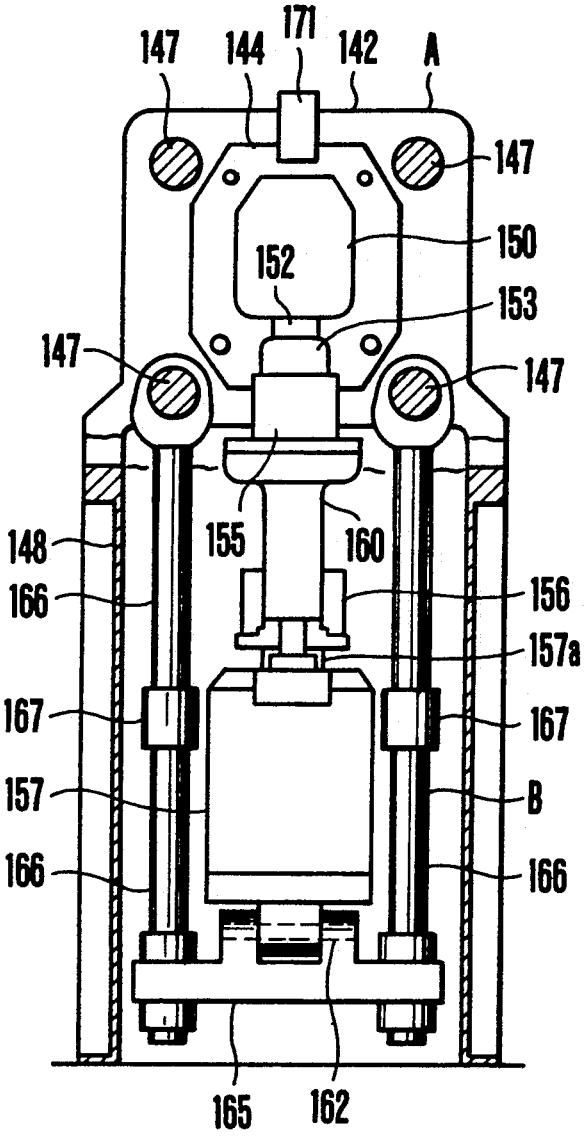
FIG. 11 is a sectional view taken along the line VII—VII in FIG. 10.

An operation of the degassing apparatus for a mold having the arrangement shown in FIG. 7 will be described with reference to FIGS. 11 and 2. The solenoid 23 is energized by the pulse counter 127 before a molten metal is injected in a product cavity 7. Since the action of the solenoid 23 is stronger than that of the compression coil spring 22, the degassing valve 1 is open. In this state, the molten metal 9 is injected into the product cavity. After the molten metal 9 almost fills the product cavity 7, it reaches the degassing groove 8. The molten metal 9 moving straight through the degassing groove 8 collides against the sensor block 24. The acoustic sensor 25 detects this collision sound and sends a detection signal to the pulse signal generator 126 via the preamplifier 14, the band filter 15, and the main amplifier 16. The pulse signal generator 126 compares the level Sb of the signal obtained by amplifying the detection signal from the acoustic sensor 25 with the predetermined reference level Sc. If the level Sb is higher than the reference level Sc, the pulse signal generator 126 generates a pulse signal, and the pulse counter 127 counts this pulse signal and compares the counted pulse number Sd with the predetermined pulse number Se. If Sd≧Se, a current supplied to the solenoid 23 is interrupted. As a result, the degassing valve 1 is closed by the action of the compression coil spring 22. When the length of the degassing groove 8 is set so that the molten metal 9 reaches the degassing valve 1 after the degassing valve 1 is closed, no molten metal 9 enters into the degassing valve 1.

In the above degassing apparatus for a mold having the arrangement of this embodiment, an erroneous operation can be prevented by comparing the pulse number Sd with the set pulse number Se by the pulse counter 127. The reason for this will be described below. That is, an acoustic wave (to be referred to as an "intrasleeve acoustic wave" hereinafter) generated in a sleeve or the like upon the start of high-speed injection or during injection and propagating to the degassing passage is rarely a large number of continuous waves but a single wave. In consideration of this fact, in order to detect a flaky or granular molten metal, the reference level of an acoustic wave is lowered, and the reference pulse number of the reference pulse number setting unit 128 is set so that the pulse counter 127 does not output the valve closing signal by the intrasleeve acoustic wave. In this manner, an acoustic wave generated by a flaky or granular molten metal can be reliably detected without an erroneous operation caused by the intrasleeve acoustic wave. In addition, when the reference pulse number is set in consideration of the length of the degassing groove 8 so that the degassing valve 1 is closed before the molten metal reaches the valve 1, no molten metal enters into the degassing valve 1.

Figure 8:
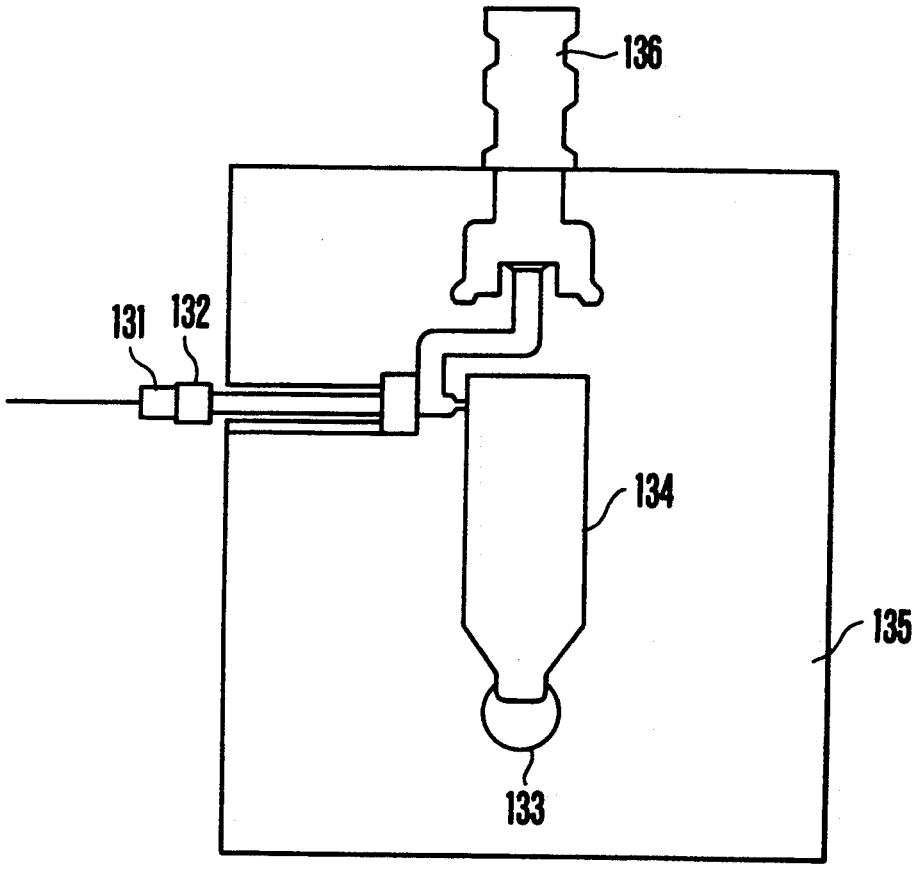
FIG. 8 is a schematic view showing still another embodiment of a degassing apparatus for a mold.

FIG. 8 shows still another embodiment of a degassing apparatus for a mold. Referring to FIG. 8, reference numeral 131 denotes an acoustic detector; 132, a sensor block; 133, a casting inlet; 134, a cavity; 135, a mold; and 136, a degassing valve.

Figure 9:
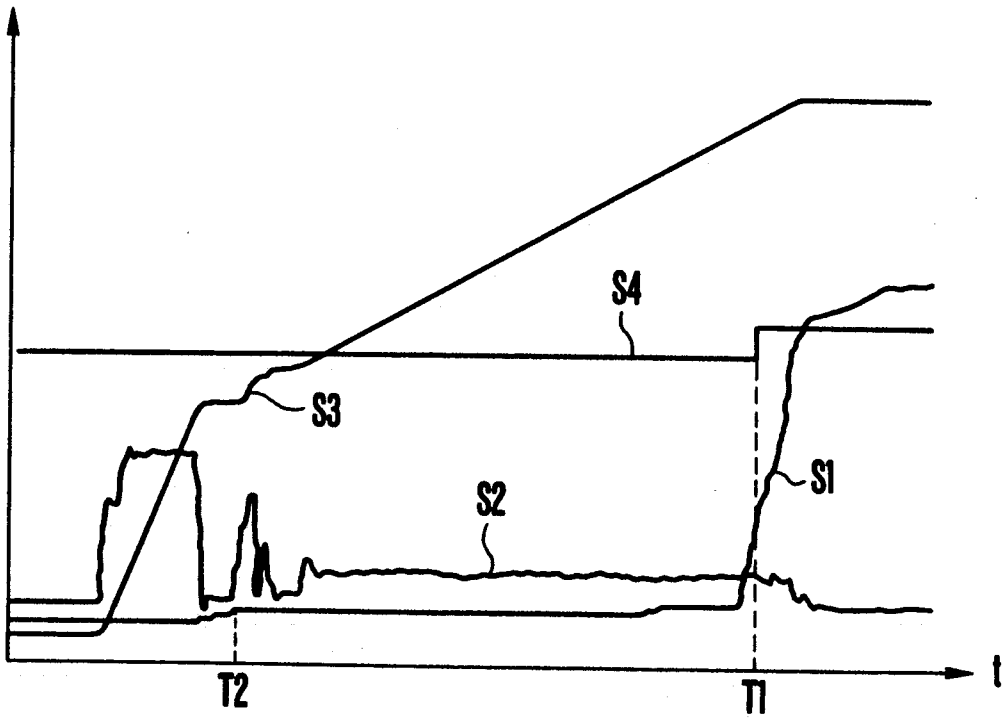
FIG. 9 is a timing chart for explaining an operation of an HVSC of the present invention.

FIG. 9 is a timing chart for explaining an operation of an HVSC of the present invention. Referring to FIG. 9, a curve $S_1$ represents a count integrated value of the pulse from the pulses signal generator 126; S2, an injection plunger velocity; S3, an injection plunger stroke; and S4, an opening/closing state of the degassing valve. In FIG. 9, reference symbol $T_1$ denotes a timing at which the degassing valve is closed; and $T_2$, a timing at which the degassing valve is closed in a conventional degassing apparatus for a mold in which a reference level of an acoustic wave is lowered to increase a molten metal detection precision. As is apparent from FIG. 9, in the conventional degassing apparatus for a mold, the degassing valve is closed at an earlier timing than that in the present invention, and a gas in the cavity is not sometimes sufficiently exhausted.

Figure 10:
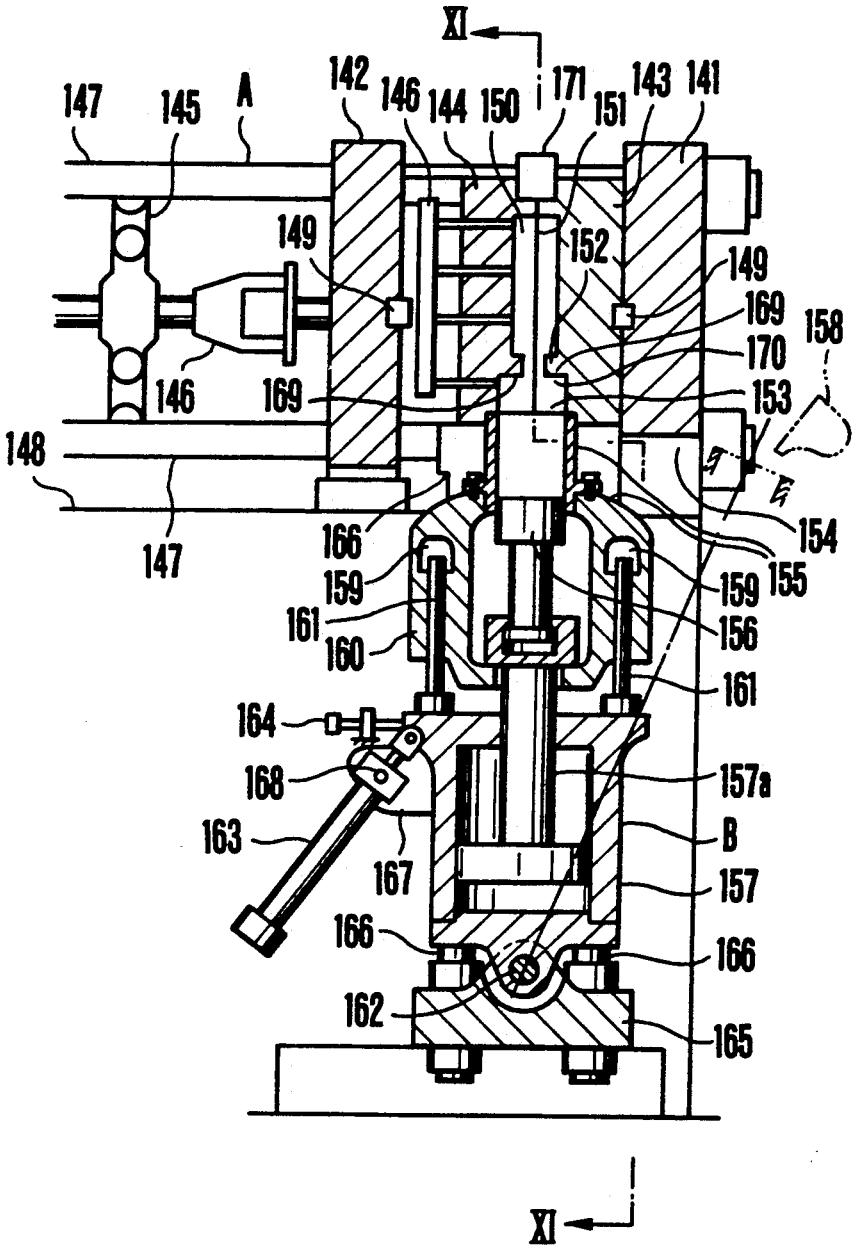
FIG. 10 is a sectional view showing a general HVSC.

A general HVSC will be described with reference to FIGS. 10 and 11. FIG. 11 is a sectional view taken along the line XI—XI in FIG. 10. Referring to FIGS. 10 and 11, reference symbol A denotes a horizontal mold-clamping unit; and B, a vertical casting unit. In the horizontal mold-clamping unit A, reference numeral 141 denotes a stationary platen; 142, a movable platen; 143, a stationary mold; 144, a movable mold; 145, a toggle ring mechanism for mold-clamping/mold-opening; 146, a product extrusion unit; 147, a column; 148, a machine base; and 149, a key for coupling the stationary and movable molds 143 and 144 to the stationary and movable platens 141 and 142, respectively. In this structure, a normal mold-clamping cylinder is operated to move the movable platen 142 and the movable mold 144 in a left-to-right direction in FIG. 10, thereby performing mold-clamping/mold-opening. A casting force acts on the molds 143 and 144 in a direction perpendicular to a direction of a mold-clamping force. Since, however, the molds 143 and 144 and the stationary and movable platens 141 and 142 are pressed by the mold-clamping force upon casting, a holding force of the key 149 need only be about 1/10 of the mold-clamping force. Reference numeral 150 denotes a cavity of the molds 143 and 144; 151, a vertical parting line between the molds 143 and 144; 152, a constricted portion at a lower portion of the cavity 150; 153, a comparatively large vertical hole portion to be coupled; and 155, a casting sleeve. An upper wall surface portion of the vertical hole portion 153 around the constricted portion 152 serves as a substantially horizontal shell entrance preventing portion 169 for preventing a shell from entering into the cavity. The shell is a thin film solidified portion of a molten metal formed on the inner wall surface of the casting sleeve 155. Reference numeral 170 denotes a shell storage portion 170.

In the vertical casting unit B, reference numberal 156 denotes an injection plunger; 157, an injection cylinder; and 158, a ladle for supplying a molten metal. The lower end of the injection plunger 156 is coupled to a piston rod **157*a* of the injection cylinder 157**.

The casting sleeve 155 is vertically detachably provided in the vertical hole portion 153 at the lower portion of the clamped molds 143 and 144. The casting sleeve 155 separated from the lower surfaces of the molds 143 and 144 can be horizontally moved while the injection plunger 156 is inserted in the casting sleeve 155.

The lower surface of the vertical hole portion 153 of the molds 143 and 144 and the upper end face of the casting sleeve 155 form a socket so as to be easily removed from each other. The lower end portion of the casting sleeve 155 is formed integrally with a block 160 which forms a cylinder 159. A ram 161 fixed to the upper portion of the injection cylinder 157 is arranged in the cylinder 159 so that the casting sleeve 155 is vertically moved by operations of the cylinder 159 and the ram 161. The cylinder 159 and the ram 161 are arranged parallel to the piston rod **157*a* of the injection cylinder 157. The lower end portion of the block 160 is slidably arranged with respect to the piston rod 157*a*. The injection cylinder 157 can be tilted about a shaft 162. The injection cylinder 157 is operated by a tilting cylinder 163, and its injection position is regulated by a stopper 164**.

The casting sleeve 155 or the injection cylinder 157 is arranged such that several vertical support rods 166 are provided from a casting frame 165 slidably held by the shaft 162, and the upper end portion of each support rod 166 is mounted on the lower column 147. A bracket 167 is mounted midway along the support rod 166, and a main body of the tilting cylinder 163 is slidably mounted on the bracket 167 by a shaft 168. Note that in FIGS. 10 and 11, reference numeral 171 denotes an internal degassing valve of the acoustic detector.

An operation of the HVSC shown in FIGS. 10 and 11 will be described below. The casting sleeve 155 is located at a position indicated by an alternate long and two short dashed line in FIG. 10 while the injection plunger 156 is inserted in the casting sleeve 155, and a molten metal is poured in the casting sleeve 155 by the ladle 158. The tilting cylinder 163 is rotated about the shaft 162 to make the vertical casting sleeve 155 perpendicular. In addition, the cylinder 159 and the piston rod 157*a* are simultaneously operated to raise the casting sleeve 155 and the injection plunger 156 up to a position indicated by a solid line in FIG. 10, thereby urging the casting sleeve 155 against the lower surface of the parting line between the clamped molds 143 and 144.

A mold-clamping operation of the horizontal mold-clamping unit A is completed before the above operation. After urging of the casting sleeve 155 is completed, a pressure oil is immediately guided to the injection cylinder 157, and the molten metal is injected from immediately below the vertical parting line 151 between the molds 143 and 144 into the molds 143 and 144. In this case, in the casting sleeve 155, a portion of the molten metal on the inner wall surface of the casting sleeve 155 begins to be solidified to produce a so-called dead molten metal or failings. This perfectly cylindrical thin solidified substance called a "shell" formed around the circumferential surface of the clean molten metal is stored in a step portion formed between the constricted portion 152 and the vertical hole portion 153 at the lower portion of the cavity 150, i.e., in the storage portion 170 immediately below the shell entrance preventing portion 169. The shell is thin and perfectly cylindrical. When the injection plunger 156 moves forward, the shell rises along the surrounding wall surface while maintaining its cylindrical shape, and abuts against the shell entrance preventing portion 169. The shell, which is compressed like a bellows, completely remains as a biscuit around the distal end of the injection plunger 156. The molten metal is sequentially supplied from a portion farthest from the shell, i.e. a high-temperature portion at the upper central portion into the hole of the constricted portion 152 and the cavity 150. In this manner, the molten metal is substantially ideally charged. Therefore, no solidified substance is injected but only a clean molten metal is injected from the high-temperature portion at the upper central portion, thereby manufacturing a good cast product. When injection is completed and cooling of the product is finished, the casting sleeve 155 is separated from the molds 143 and 144, and the movable mold 144 is opened to release the product. The product and the compressed molten metal portion are extruded by the product extrusion unit 46. As described above, the injection plunger 156 moves downward, and at the same time the casting sleeve 155 moves downward by the cylinder 159. When descents of the two members are completed, the tilting cylinder 163 operates to tilt the vertical casting unit B to a molten metal supply position indicated by the alternate long and two short dashed line, thereby completing one cycle.

Note that the degassing valve 136 of the degassing apparatus shown in FIG. 8 can be applied to not only an HVSC (horizontal clamping/vertical casting die-casting machine) but also to a general horizontal clamping-/vertical casting die-casting machine or a vertical clamping/vertical casting die-casting machine (VSC).

As has been described above, the above embodiment comprises an acoustic wave detecting means, provided in the middle of a molten metal passage, for detecting an acoustic wave generated when a molten metal collides against a wall surface of the molten metal passage and thereby recognizing passing of the molten metal, a pulse signal generating means for comparing a detection signal level output from the acoustic wave detecting means with a reference level, and generating an electrical signal pulse when the detection signal level is higher than the reference level, a pulse counter for counting the number of the electrical signal pulses, and generating an electrical signal when the count reaches a predetermined count, and a valve closing mechanism for closing the valve in accordance with the electrical signal from the pulse counter. In this arrangement, the acoustic wave reference level is lowered to detect a flaky or granular molten metal, and the predetermined count is set such that no valve closing signal is output by an intrasleeve acoustic wave. Therefore, a product cavity can always be stably breathed without closing the degassing valve too early by the intrasleeve acoustic wave or allowing the molten metal to enter into the degassing valve.

FIG. 1 shows still another embodiment wherein when an event in which a detection signal level exceeds a reference level occurs within a first predetermined period and continues for a second predetermined period or more, an electrical signal is generated to close a valve.

Figure 12:
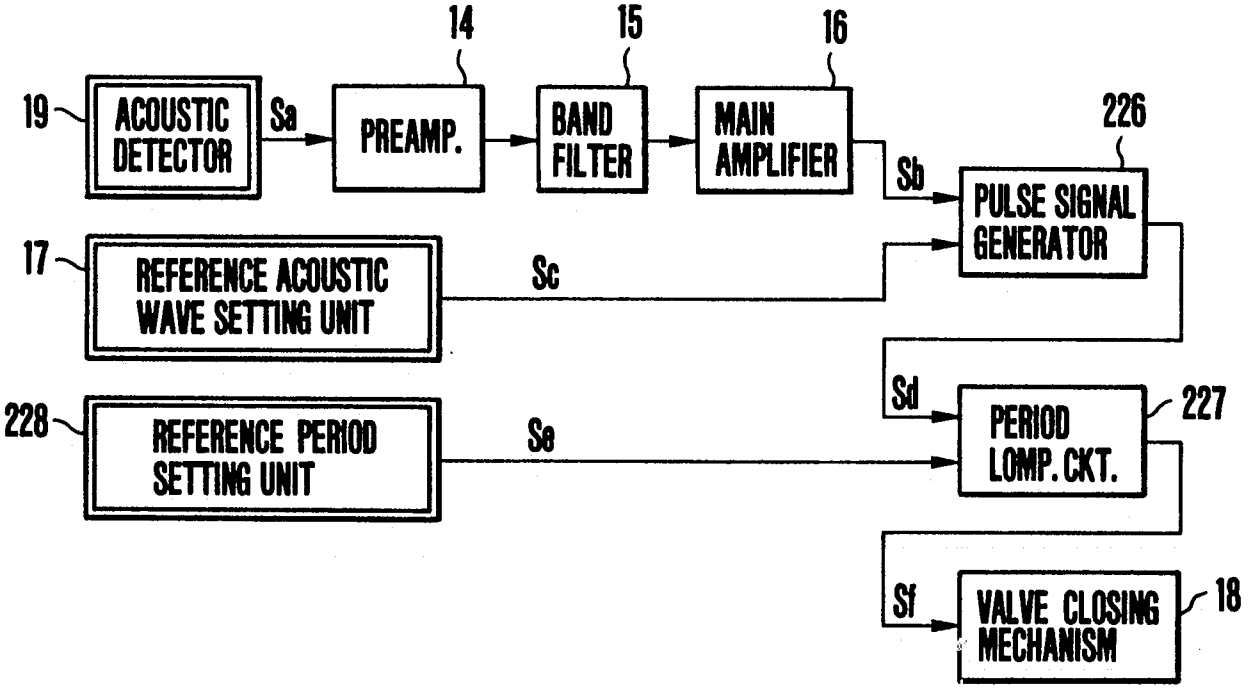
FIG. 12 is a block diagram showing still another embodiment of the present invention.

Referring to FIG. 12, a detection signal of level Sb (see FIG. 13A) output from a main amplifier 16 and a reference signal of level Sc (see FIG. 13A) set by a reference acoustic wave setting unit 17 are supplied to a pulse signal generator 226.

The pulse signal generator 226 compares the two signals. If $Sb \geqq Sc$, the pulse signal generator 226 outputs a pulse signal Sd (see FIG. 13B). The pulse signal generator 226 has the same function as that of a retriggerable mono-multivibrator and outputs a pulse signal of level "H" for a first predetermined period (Tr) from a timing at which the level Sb of the detection signal exceeds the level Sc of the reference signal. If a period Ta from the timing at which the pulse signal is generated to the timing at which the level Sb of the detection signal exceeds the level Sc of the reference signal is shorter than the first predetermined period, this pulse signal is retriggered to hold the level "H" for the first predetermined period. Therefore, if the level Sb of the detection signal exceeds the level Sc of the reference signal within the first predetermined period, the pulse signal continuously holds the level "H".

If the level Sb of the detection signal does not reach the level Sc of the reference signal within the first predetermined period, the pulse signal goes to the level "L" at the timing.

Figures 13A, 13B:
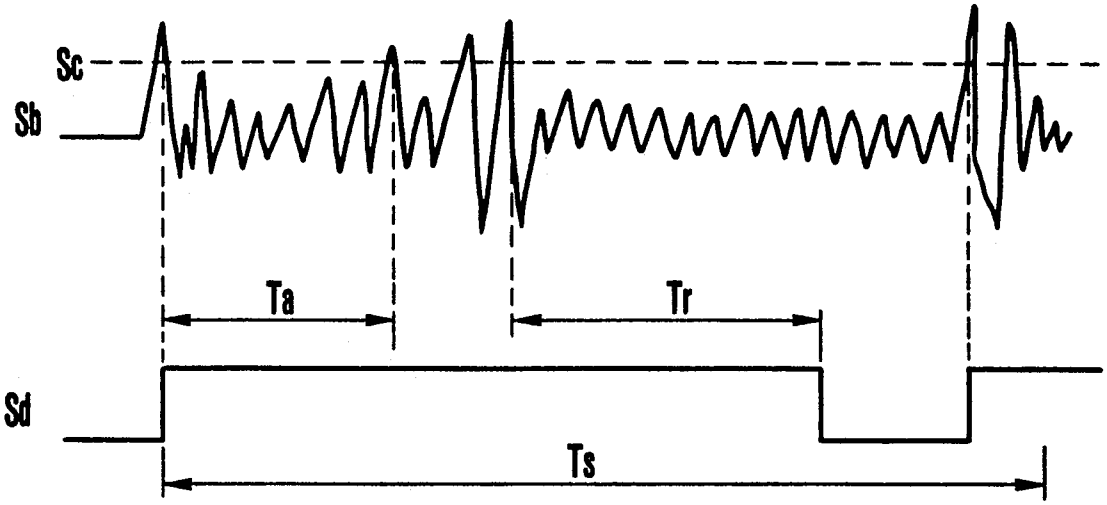
FIGS. 13A and 13B are timing charts showing signal waveforms in the embodiment shown in FIG. 12.

The pulse signal output from the pulse signal generator 226 and a reference period signal Se output from a reference period setting unit 228 are supplied to a period comparator 227. The period comparator 227 compares a period in which the pulse signal Sd is at level "H") with a second predetermined period (Ts) indicated by the reference period signal Se. The second predetermined period is longer than the first predetermined period (Tr). Since the level "H" period of the pulse signal Sd shown in FIG. 13B is shorter than the second predetermined time (Ts), the period comparator 227 does not output a closing signal Sf.

If, however, a molten metal moves close to a degassing valve and an event in which the level Sb of the detection signal exceeds the level Sc continuously occurs within the first predetermined period, the level "H" period of the pulse signal Sd is prolonged to finally exceed the second predetermined period (Ts). At this time, the period comparator 227 outputs the closing signal Sf, and a valve closing mechanism 18 closes the degassing valve.

What is claimed is:

1. A degassing apparatus for a mold comprising:

a degassing valve located at an end portion of a degassing passage extending from a mold cavity, wherein said degassing passage has a bent portion;

an acoustic wave detecting unit, arranged midway along said degassing passage, for detecting an acoustic wave generated when a molten metal collides against a wall surface of said passage, and thereby detecting passing of the molten metal, wherein said acoustic wave detecting unit is disposed adjacent to said bent portion; and a valve closing unit for closing said valve when a detecting signal level is higher than a reference signal level.

2. An apparatus according to claim 1, wherein said acoustic wave detecting unit comprises a cylindrical sensor block having a bottom, and an acoustic sensor mounted on said bottom.

3. An apparatus according to claim 1, wherein said valve closing unit comprises a comparator for comparing the detection signal level with the reference signal level and a valve closing mechanism for closing said degassing valve.

4. An apparatus according to claim 1, wherein said valve closing unit comprises:

pulse signal generating means for generating a pulse signal when the detection signal level is higher than the reference signal level; and means for counting the pulse signal and supplying a valve closing signal when the count reaches a predetermined count.

5. An apparatus according to claim 1, wherein said valve closing unit comprises:

pulse signal generating means for outputting, when the detection signal level is higher than the reference level, a signal of level "H" for only a first predetermined period from the timing at which the detection signal level exceeds the reference level, and when the detection signal level becomes higher than the reference level again within the first predetermined period, continuously outputting a signal of level "H" for the first predetermined period from the timing at which the detection signal level exceeds the reference level; and period comparing means for outputting a valve closing signal for closing said valve when a level "H" period of the pulse signal exceeds a second predetermined period longer than the first predetermined period.

* * * * *

UNITED STATES PATENT AND TRADEMARK OFFICE

CERTIFICATE OF CORRECTION

PATENT NO. : 5,004,038

DATED : April 2, 1991

INVENTOR(S) : Minoru Kuriyama

It is certified that error appears in the above-identified patent and that said Letters Patent is hereby corrected as shown below:

Col. 6, line 39, after first occurrence of "Sb" insert --.--;

Col. 7, line 48, change "$S_1$" to --S1--;

Col. 9, line 40, after "i.e." insert --,--;

Col. 10, line 23, change "FIG. 1" to --FIG. 12--;

Col. 11, line 21, change "detecting" to --detection--.

Signed and Sealed this

Ninth Day of May, 1995

Bruce Lehman

*Attest:*

BRUCE LEHMAN

*Attesting Officer*

*Commissioner of Patents and Trademarks*